United States Patent [19]

Napier

[11] 4,066,060

[45] Jan. 3, 1978

[54] BOW STRING RELEASE DEVICE

[76] Inventor: Loyd S. Napier, Rte. 1, Box 417A, Sapulpa, Okla. 74066

[21] Appl. No.: 684,114

[22] Filed: May 7, 1976

[51] Int. Cl.[2] ..... F41C 17/00

[52] U.S. Cl. ..... 124/35 A

[58] Field of Search ..... 124/35 A, 24 R, 23 R, 124/41 A, 80, 19

[56] References Cited

U.S. PATENT DOCUMENTS

| | | | |
|---|---|---|---|
| 1,469,610 | 10/1923 | Ustynik | 124/35 R X |
| 2,786,641 | 3/1957 | Pelsue | 124/35 R X |
| 3,461,852 | 8/1969 | Brothers | 124/35 A |
| 3,788,299 | 1/1974 | Mathews | 124/35 R |
| 3,845,752 | 11/1974 | Barner | 124/35 A |
| 3,847,133 | 11/1974 | Awiszus | 124/35 A X |
| 3,916,868 | 11/1975 | Wolfe | 124/35 A |
| 3,954,095 | 5/1976 | Lewis | 124/80 X |
| 4,009,703 | 3/1977 | Cunningham, Sr. | 124/35 A |

*Primary Examiner*—Richard C. Pinkham

*Assistant Examiner*—William R. Browne

*Attorney, Agent, or Firm*—Head, Johnson & Chafin

[57] ABSTRACT

A trigger device for facilitating pulling of a bow string and for quick release of the taut bow string for propelling an arrow from the bow, said trigger device comprising a main body portion provided with suitable finger receiving recesses and a secondary body portion substantially perpendicular to the main body portion having a bow string hold and releasing latch mechanism carried thereby. The latching mechanism comprises a flexible loop member adapted for encircling the bow string and engaging a loop receiving recess provided in the secondary body portion. A latch member extends across the open end of the loop receiving recess and is operably connected with a release trigger by a suitable bell crank whereby a light touch of the trigger member by the finger of the archer quickly and easily releases the loop from the loop recess for release of the taut bow string. The bell crank is L-shaped and is positioned in a generally L-shaped passageway in the trigger device.

7 Claims, 6 Drawing Figures

BOW STRING RELEASE DEVICE

BACKGROUND OF THE INVENTION

1. Field of the Invention

This invention relates to improvements in bow string trigger devices and more particularly, but not by way of limitation, to a trigger device for easily pulling the bow string taut and quickly and smoothly releasing the taut bow string.

2. Description of the Prior Art

In the usual present-day use of a bow and arrow, the bow string is pulled away from the bow by the forefinger and middle finger of the archer's hand. The string is normally somewhat difficult to pull back and requires a considerable pressure, which may be very uncomfortable or painful for the fingers. In order to facilitate the pulling of the bow string, trigger devices have been developed which may be held somewhat comfortably in the hand and in turn engage the bow string. One such device is shown in the Barner U.S. Pat. No. 3,845,752, issued Nov. 5,1974 and entitled "Combined Bowstring Draw and Trigger Release Mechanism for Use in Archery". These devices have been of great help, but they have certain disadvantages in that the release of the bow string is usually not quick enough or smooth enough and frequently interferes with the accuracy and overall result of the archery operation.

SUMMARY OF THE INVENTION

The present invention contemplates a novel trigger device for a bow and arrow which has been particularly designed and constructed for overcoming the foregoing disadvantages. The novel trigger device comprises a main body portion having suitable finger receiving recesses along at least one edge thereof whereby the device may be comfortably held in one hand or the other during the archer operation. A secondary body portion extends substantially perpendicular from the main body portion and is provided with latching means at the outer end thereof for engaging and releasing the bow string. The latching means comprises a flexible loop, preferably constructed of suitable string material, secured to the secondary body and adapted to encircle a portion of the bow string. A loop receiving recess is provided in the outer end of the secondary body for receiving the loop therein subsequent to wrapping of the loop around the bow string, thus securing the bow string to the trigger device. A releasable latch member extends across the open end of the loop receiving recess and is movable in one direction for opening to permit the loop to be inserted into the recess, and movable in an opposite direction for closing to retain the loop therein. A release trigger member is provided in the main body portion and disposed at a convenient position for manipulation by the fingers of the archer, preferably the little finger. The release trigger member is operably connected with the latch member by suitable bell crank means whereby the latch member is quickly and easily moved away from the open end of the loop receiving recess when the trigger member is engaged or tripped. When the latch member is removed from its position across the open end of the loop receiving recess, the loop is released from its position therein, and the bow string is quickly and efficiently released for propelling of the arrow in the usual manner. The bell crank means connected between the trigger member and the latch member is particularly designed for efficiency and accuracy of operation in releasing the latch member.

DESCRIPTION OF THE PREFERRED EMBODIMENT

Figure 3:
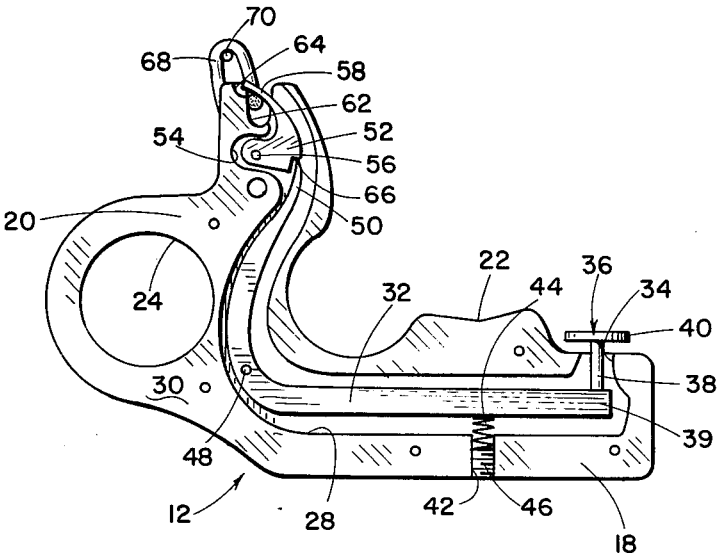
FIG. 3 is a view similar to FIG. 2 illustrating the latch member in a closed position.

Referring to the drawings in detail, reference character 10 generally indicates a bow string draw and release device comprising a pair of substantially identical but opposite half sections 12 and 14 removably secured together in any well-known manner, such as by a plurality of screws 16. Since the half section 12 and 14 are substantially identical, but mirror images of one another, only one section 12 will be set forth in detail herein.

The half section 12 comprises a somewhat elongated, substantially flat main body portion 18 having a secondary flat body portion 20 extending substantially perpendicularly therefrom, and preferably integral therewith, but not limited thereto. One edge of the mail body 18 is contoured to suitable finger receiving recesses as shown at 22 for facilitating use of the device 10 as will be hereinafter set forth. In addition, an aperture 24 is preferably provided in the secondary body portion 20 for receiving a finger 26 therethrough during use of the device.

A substantially L-shaped groove 28 is provided on the inwardly directed face 30 of the half section 12 for cooperating with the groove 28 of the half section 14 to provide an integral passageway for pivotally receiving a bell crank member 32 therein. An auxiliary recess 34 is provided in the race 30 to provide communication between the recess 28 and the open area in the proximity of the finger receiving contours 22 as particularly shown in FIGS. 1 and 2. A trigger member 36 comprising a stem 38 and head member 40 is disposed in the recess 40 in such a manner that the stem 38 extends into engagement with the bell crank 32 in the proximity of one end 39 thereof, and the head member 40 is disposed exteriorly of the body portion 18 in the proximity of the finger-receiving contours 22. The stem 38 may be adjustably secured to the bell crank 32 in any well-known manner, such as by a threaded connection therewith (not shown). A second auxiliary recess 42 is provided in the face 30 oppositely disposed with respect to the recess 34 and longitudinally spaced therefrom for cooperation with the corresponding recess of the half section 14 to provide a bore for receiving a suitable spring 44 and retainer member 46 therein. The bore formed by the companion recesses 42 is preferably threaded whereby the retainer plug 46 may be threadedly secured therein for adjusting the pressure of the force of the spring 44 against the lower edge of the bell crank 32 as viewed in FIGS. 2 and 3. Thus, the spring member 44 urges the right-hand end of the bell crank 32 upwardly, as viewed in FIGS. 2 and 3 for a purpose as will be hereinafter set forth.

Figure 2:
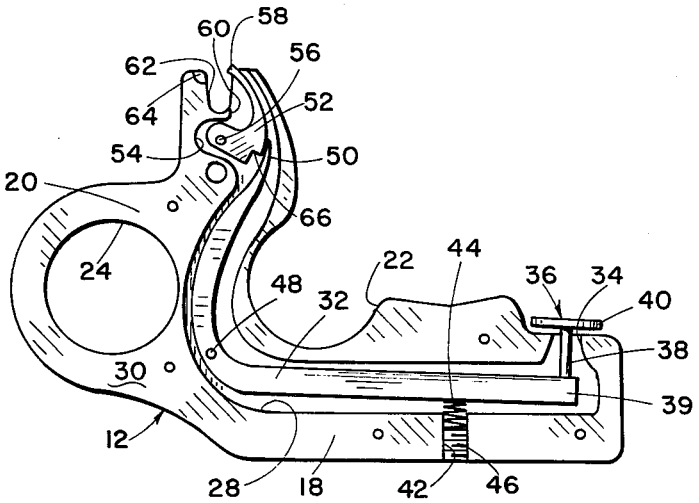
FIG. 2 is a side elevational view of one half section of the bow string draw and release device shown in FIG. 1 and illustrating the latch member in an open position.

The bell crank 32 is of a substantially L-shaped configuration, complementary to the configuration of the recess 28 and may be pivotally secured therein in any suitable manner, such as by a pivot pin 48. The upstanding end 50 of the bell crank 32, as viewed in FIGS. 2 and 3, is curved or bent in a rearward direction in such a manner that is terminates at a point disposed between the pivot pin 48 and the end 39 of the bell crank 32. In addition, the end 50 is preferably of a tapered configuration and terminates in a relatively thin or pointed element for engagement with a pivotal latch member 42. The latch member 52 is pivotally secured within an enlarged recess portion 54 conterminous with the recess 28 by a suitable pivot pin 56 and is so constructed that the preponderance of weight of the latch member 52 normally lies on the right-hand side of the pivot 56, as viewed in FIGS. 2 and 3, whereby gravity constantly urged the latch member 52 to rotate about the pivot 56 in a clockwise direction, as viewed in FIGS. 1 through 3.

The outer end 58 of the latch member 52 is of a tongue-like configuration and extends through an open end 60 of the enlarged recess 54 and into a loop receiving recess or groove 62 provided in the outer end of the secondary body portion 20. In one position of the latch member 52, as shown in FIG. 2, the latch end 56 is disposed at one side of the loop receiving recess 62, or may be completely withdrawn therefrom; and in another position of the latch member 52, as shown in FIG. 3, the latch end 56 is disposed in a notch 64 provided in the loop recess 62, all for a purpose as will be hereinafter set forth. In addition, the latch member 52 is provided with a notch or shoulder 66 oppositely disposed with respect to the latch end 56 for receiving the end 50 of the bell crank 32 therein in one position of the latch 52, as particularly shown in FIG. 3.

It is to be particularly noted that the pivot pin 48 is disposed forwardly of the pivot pin 56, as viewed in FIGS. 2 and 3, considering that the trigger member 36 is disposed at the rear of the device 10, and the finger receiving bore 24 is at the front thereof. This relationship between the two pivot pins appears to provide a more efficient result in the operation of the device 10 by permitting a quicker, more positive, more efficient action of the releasing of the latch member 52, as will be hereinafter set forth in detail.

A suitable flexible loop member 68, preferably constructed of a heavy string, or light rope, but not limited thereto, has one end securely anchored to the half section 12 and the other end sucurely anchored to the half section 14 whereby the loop 68 extends loosely across the outer end of the secondary body member 20 in the proximity of the loop receiving recess 62. The loop member 68 may be wrapped about a bow string 70 of a bow 72 and placed in the loop receiving recess 62 for temporarily securing the bow string 70 to the device 10 in a manner and for a purpose as will be hereinafter set forth. Of course, the latch member 52 may be moved to the closed or latched position thereof shown in FIG. 3 for retaining the loop 68 within the recess 62, and moved to the open or unlatched position thereof as shown in FIG. 2 for releasing the loop 70 from the recess 62.

Figure 1:
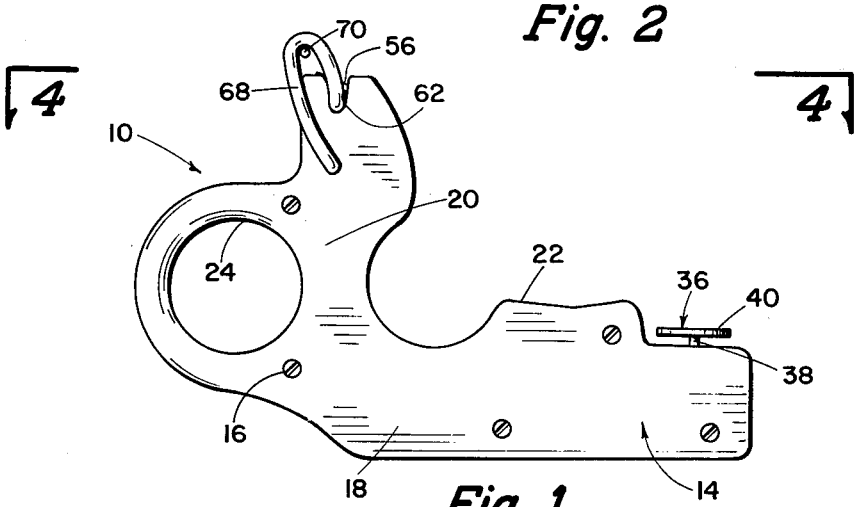
FIG. 1 is a side elevational view of a bow string draw and release device embodying the invention.
Figure 5:
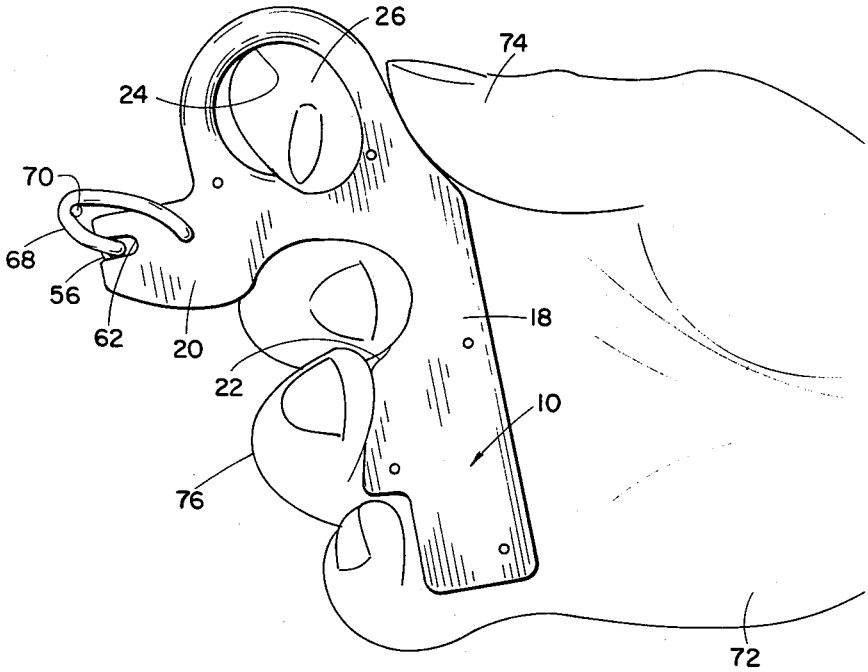
FIG. 5 is a side elevational view of the bow string draw and release device shown in FIG. 1 as held in the hand of an archer.
Figure 4:
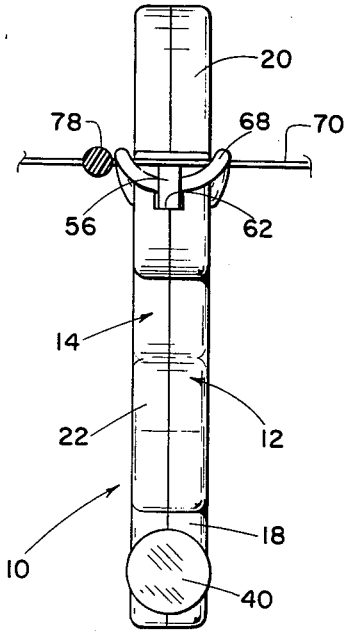
FIG. 4 is a view taken on line 4—4 of FIG. 1.
Figure 6:
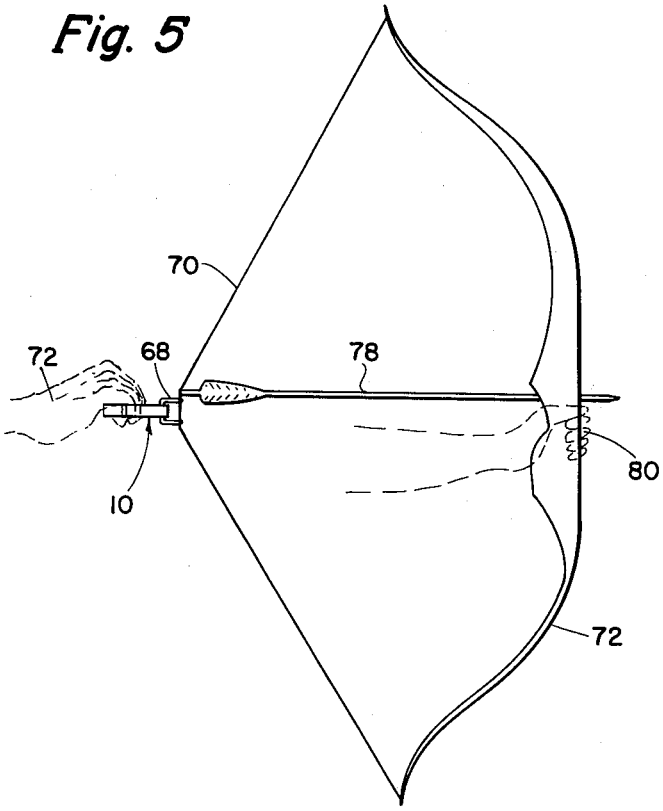
FIG. 6 is a side elevational view of a bow string draw and release device embodying the invention as in use with a bow and arrow, with portions illustrated in broken lines for purposes of illustration.

In use, the device 10 may be comfortably held in the hand 72 of the archer, as clearly shown in FIG. 5. The forefinger 26 may be inserted through the aperture 24, and the thumb 74 may be placed adjacent the outer edge of the device at the juncture between the body portions 18 and 20. The remaining fingers 76 may be positioned against the finger receiving contoured portion 22, thus comfortably supporting the device 10 in the hand 72. During the use of the device 10 for drawing or pulling the bow string 70 taut, as shown in FIG. 6, it is preferable that the device 10 be held in such a manner that the plane of the body portions 18 and 20 be substantially horizontally disposed, with the loop 68 being positioned in the proximity of the bow string 70. The loop 68 may then be manually wrapped around the string 70 one time and brought back into position within the loop recess 62, as shown in FIGS. 1 and 3. The latch member 52 may then be manually pivoted about the pivot 56 to the closed position shown in FIGS. 1, 3, and 4 for securely retaining the loop 68 in the recess 62. In this position of the latch 52, the end 50 of the bell crank 32 will automatically engage the shoulder 66 because of the force of the spring 44. The bow 72 may be held in the usual position, and the bow string 70 may be drawn away from the bow 72 by applying pressure against the device 10, in lieu of the conventional present-day method of pulling against the string with the fingers.

Of course, an arrow 78 may be positioned in connection with the bow 72 and string 70 in the usual manner, with the string 70 being disposed in the notch of the arrow and the point end of the arrow being disposed at a resting position on the hand 80 of the archer. When the string 70 has been properly drawn or pulled away from the bow and the arrow is to be released, the trigger head 40 may be engaged by the little finger of the hand 72, whereupon the bell crank 32 will be rotated in a clockwise direction about the pivot pin 48, as viewed in FIGS. 1 through 3. The action pulls the end 50 away from the shoulder 66 and releases the latch member 52, which is free to pivot about the pin 56 in a clockwise direction, as viewed in these same figures. The movement of the latch member 52 opens the loop receiving recess 62 for releasing the loop 68 therefrom. Of course, the tension in the string 70 causes the string to immediately disengage from the loop 68 and propel the arrow 78 forwardly from the bow 72.

The amount of pressure required for activation of the trigger member 36 is extremely slight, and the action of the bell crank 32 is very rapid and accurate, thus providing an efficient release of the string 70 for accuracy of the projection of the arrow. Of course, the pressure required for actuation of the trigger 36 may be adjusted by the retainer member 46 engaging the spring 44. When it is desired to provide a substantially "hair trigger" action, the retainer 46 may be adjusted with respect to the spring 44 for responding with relatively little pressure on the head 40. Conversely, when it is desired that the trigger 36 be less "quick" acting, the retainer 46 may be adjusted with respect to the spring 44 for responding only when a greater force is applied on the head 40.

In other words, the force of the spring 46 against the arm 32 is in a counterclockwise direction about the pivot 48, as viewed in FIG. 3, whereas the pressure of the bow string 70 on the rope 68 and in turn on the outer end 58 of the latch member 52 creates a pressure on the bell crank 32 in a clockwise direction about the pivot 48. Additional pressure is a clockwise direction is applied to the bell crank 32 by the trigger 36 when the operator's finger is pressed against the head 40. When the combined pressures or forces of the trigger 36 and latch 52 coacting on the bell crank 32 overcomes the pressure or force of the spring 46, this bell crank 32 will instantly pivot in a clockwise direction about this pivot 48. Thus, the release of the bow string 70 is directly in relation to the pressure of the bow string applied to the outer end 58 of the latch 52 by the rope 68.

Subsequent to one arrow shooting operation, the procedure may be repeated by again wrapping the loop 68 around the string 70 and placing the loop in the recess 62, and again moving the latch member 52 to the locked or latched position thereof. When the arrow 78 has been properly positioned in combination with the bow 72 and string 70, and the string 70 has been pulled or drawn, the trigger member 36 may again be actuated for quickly and smoothly releasing the loop 68 from the recess 62, and thus releasing the string 70.

From the foregoing, it will be apparent that the present invention provides a novel bow string draw and release device having a main body portion designed for comfortably receiving the fingers of the hand therearound, and a secondary body portion carrying a quick-release latching mechanism for temporarily retaining a bow string holding loop member in order to facilitate drawing of the bow string and for quickly and efficiently releasing the loop member for release of the bow string to perform an arrow shooting operation with ease and accuracy. The novel device is simple and efficient in operation and economical and durable in construction.

Whereas the present invention has been described in particular relation to the drawings attached hereto, it should be understood that other and further modifications apart from those shown or suggested herein may be made within the spirit and scope of this invention.

What is claimed is:

1. A draw and release device for a bow string and comprising generally L-shaped body means contoured for gripping by a hand and having a substantially coextensive L-shaped internal passageway means with an open end for receiving a bow string and provided therein with a substantially coextensive L-shaped pivotal bell crank means disposed within said passageway means for movement between latch means engaging and releasing positions, independent trigger means carried by said body means and operably connected with said bell crank means for selective pivoting said crank means to pivot bell crank so as to release a latch means from bow string engaging position, latch means pivotally secured within said body means and in communication with said passageway means for selective engagement by said bell crank means, flexible loop means secured to said body means for selective engagement with the bow string, loop receiving recess means provided on the outer periphery of said body means for removably receiving said loop means therein, said latch means extending transversely across said loop receiving recess means and being selectively engageable therewith for alternate opening and closing thereof to alternately retain and release said loop means with respect to said loop receiving recess means.

2. A bow string draw and release device as set forth in claim 1 wherein said body means is provided with finger receiving recess means on the outer edge thereof for facilitating manipulation of said device.

3. A bow string draw and release device as set forth in claim 1 wherein said bell crank means is pivotally secured within said passageway means at a point forwardly of the pivot point of said latch means.

4. A draw and release device for a bow string as set forth in claim 1 wherein said trigger means comprises a stem member having one end disposed within said passageway means and operably connected in the proximity of one end of said bell crank means and the opposite end extending exteriorly of said body means, and a head member carried by the exterior end of the stem member and disposed exteriorly of said body means for access to facilitate actuation of said trigger means.

5. A draw and release device for a bow string as set forth in claim 1 wherein said latch means comprises a latch member pivotally secured within said body means in the proximity of one end of the passageway means and having notch means on the outer edge thereof for engagement by said bell crank means, and a tongue-like member provided on one end of said latch member opposite from said notch means for extending transversely across said loop receiving recess in one position of said latch member for closing of said recess.

6. A draw and release device for a bow string as set forth in claim 1, further comprising an adjustable means which is a part of said trigger means, for regulating the force required for actuation thereof.

7. A draw and release device for a bow string as set forth in claim 1, further including a stem member, which is a part of the trigger means, operably connected in the proximity of one end of said bell crank means, and a head member carried by the stem member and disposed exteriorly of said body means for access to facilitate actuation of said trigger means, and wherein said trigger means includes adjustable spring means engageable with said bell crank means for regulating the force required for actuation of said trigger means.

* * * * *